US009702197B2

(12) United States Patent
Mitchell

(10) Patent No.: US 9,702,197 B2
(45) Date of Patent: Jul. 11, 2017

(54) REAMER SHOE ATTACHMENT FOR FLEXIBLE CASING SHOE

(71) Applicant: WWT NORTH AMERICA HOLDINGS, INC., Houston, TX (US)

(72) Inventor: Sarah Mitchell, Corona, CA (US)

(73) Assignee: WWT North America Holdings, Inc., Houston, TX (US)

( * ) Notice: Subject to any disclaimer, the term of this patent is extended or adjusted under 35 U.S.C. 154(b) by 21 days.

(21) Appl. No.: 14/679,961

(22) Filed: Apr. 6, 2015

(65) Prior Publication Data

US 2015/0308195 A1 Oct. 29, 2015

Related U.S. Application Data

(60) Provisional application No. 61/985,990, filed on Apr. 29, 2014.

(51) Int. Cl.
*E21B 10/26* (2006.01)
*E21B 17/14* (2006.01)
*E21B 17/20* (2006.01)

(52) U.S. Cl.
CPC ..... *E21B 10/26* (2013.01); *E21B 17/14* (2013.01); *E21B 17/20* (2013.01)

(58) Field of Classification Search
CPC ..... E21B 10/26; E21B 17/20; E21B 17/14
See application file for complete search history.

(56) References Cited

U.S. PATENT DOCUMENTS 3,148,004 A 9/1964 Hall et al.
3,343,890 A 9/1967 Homer
3,480,094 A 11/1969 Morris
3,871,488 A 3/1975 Sabre
3,948,575 A 4/1976 Rosser
4,402,551 A * 9/1983 Wood ..... E21B 7/061 166/117.5
4,602,690 A 7/1986 Steiger
4,796,670 A 1/1989 Russell et al.
5,332,049 A 7/1994 Tew
5,901,798 A 5/1999 Herrera et al.
6,070,665 A * 6/2000 Singleton ..... E21B 7/061 166/242.1
6,666,267 B1 12/2003 Charlton
7,604,059 B2 10/2009 Thornton
7,617,879 B2 11/2009 Anderson et al.
8,657,036 B2 2/2014 Barron et al.
(Continued)

FOREIGN PATENT DOCUMENTS

WO WO 2011/025488 A1 3/2011

OTHER PUBLICATIONS

Notification of Transmittal, International Search Report and Written Opinion for corresponding International Application No. PCT/US2015/024973; date of mailing Jul. 6, 2015; 8 pages.

*Primary Examiner* — David Andrews
*Assistant Examiner* — Kristyn Hall
(74) *Attorney, Agent, or Firm* — Lewis Roca Rothgerber Christie LLP

(57) ABSTRACT

A drillable reamer shoe having a reamer body and a nose section having a metallic cage containing a plurality of ceramic inserts made from silicon nitride or aluminum oxide. The drillable reamer shoe is positioned on an end of a flexible wellbore casing guide comprising a tubular body having a stiffness lower than a wellbore casing.

16 Claims, 5 Drawing Sheets

(56) References Cited

U.S. PATENT DOCUMENTS

| | | | | |
|---|---|---|---|---|
| 2008/0099250 | A1* | 5/2008 | Hall | B23B 51/00 175/426 |
| 2009/0120693 | A1 | 5/2009 | McClain et al. | |
| 2010/0101870 | A1* | 4/2010 | Shamburger | E21B 10/04 175/431 |
| 2011/0100723 | A1 | 5/2011 | Scott et al. | |
| 2012/0255743 | A1 | 10/2012 | Oxford | |
| 2014/0110098 | A1 | 4/2014 | Mitchell et al. | |

* cited by examiner

REAMER SHOE ATTACHMENT FOR FLEXIBLE CASING SHOE

CROSS-REFERENCE TO RELATED APPLICATION(S)

This application claims priority to and the benefit of U.S. Provisional Application No. 61/985,990, filed Apr. 29, 2014 the contents of which are incorporated herein by reference.

BACKGROUND

The present invention is directed to a downhole tool, and more particularly to a reamer shoe attachment for a flexible casing guide running tool.

In oil and gas exploration and production operations, bores are drilled to gain access to subsurface hydrocarbon-bearing formations. The bores are typically lined with steel tubing, known as tubing, casing or liner, depending upon diameter, location and function. The tubing is run into the drilled bore from the surface and suspended or secured in the bore by appropriate means, such as a casing or liner hanger. For a casing, cement may then be introduced into the annulus between the tubing and the bore wall.

As the tubing is run into the bore, the tubing end will encounter irregularities and restrictions in the bore wall, for example ledges formed where the bore passes between different formations and areas where the bore diameter decreases due to swelling of the surrounding formation. Further, debris may collect in the bore, particularly in highly deviated or horizontal bores. Accordingly, the tubing end may be subjected to wear and damage as the tubing is lowered into the bore. These difficulties may be alleviated by providing a shoe on the tubing end. Examples of casing shoes of various forms are well known in the art.

Another problem encountered is the difficulty of running casing through build sections. More specifically, there is difficulty in running large diameter casing through the build section of a well in moderate to soft formations. The stiffness of the casing requires a significant force that must be generated at the casing shoe to cause the casing to bend to follow the curved section of the wellbore.

Often times a reamer bit is attached to the bottom of a casing shoe for opening the hole and smoothing areas that may have ledges or under-gauge areas where the diameter of the hole is not large enough to allow passage of the casing. Often, a bit or reamer attached to the casing or liner must itself be able to be drilled. Existing reamer shoes that can be drilled are often made of aluminum, ceramic powder polymer composites, or fiber reinforced composites, with tungsten carbon inserts or grit. The use of metallic carbide, usually tungsten carbide, are in the form of sintered compact inserts, welded hardfacing, or grit that is included in a matrix. Also, polycrystalline diamond (PDC) inserts are sometimes used. The problem with PDC inserts is that they are expensive, and are made by bonding a layer of diamond to tungsten carbide. Tungsten carbide is very hard, abrasive and most importantly has a very high density. This means the reamer will be difficult to drill, and when it is drilled through, the tungsten carbide pieces are going to reside in the bottom of the well and because of their high density precludes them from being flushed out of the hole through normal circulation. In horizontal and directional wells, these pieces can cause wear and damage to other steel downhole components during further drilling operations. Consequently, a need exists for a reamer shoe attachment for a flexible casing shoe that solves the problems of existing reamer shoe designs.

SUMMARY OF THE INVENTION

The present invention is directed to a reamer shoe attachment for a flexible casing shoe having ceramic inserts, made from silicon nitride and/or aluminum oxide. Silicon nitride and aluminum oxide are harder than most rock materials, but are far lower in density than tungsten carbide material normally used as a reamer shoe. Silicon nitride and aluminum oxide are far easier to be broken up and flushed harmlessly out of the hole when it is required to drill through the reamer when drilling the next wellbore section. In addition, these materials can be broken up if needed using PDC and tungsten carbide which enhances their drillability.

The ceramic inserts are held in the reamer body using a metallic framework or cage to locate the inserts and provide a load bearing structure to support the loads and conduct heat away from the inserts. The framework is preferably made of a strong and light aluminum alloy, but also could be made using steel. The framework and inserts can be cast into the body using anyone of several open casting methods using liquid materials that solidify to faun a solid structure. The inserts for the reamer shoe could reside in narrow ribs on the outside diameter of the reamer shoe, with wider ribs included to limit the depth of the cuts so that the cutting surfaces are not overloaded. Narrow and wider rib designs also ensure that drilling fluid is guided past the inserts to cool them and transport cuttings uphole.

The reamer shoe could be placed at the front end of a flexible casing shoe, or could form an integral part of the flexible casing shoe. The flexible casing shoe is a short, 20 to 500 foot, guiding section in front of the casing which has a lower stiffness than the casing. The guiding section is a cylindrical or tubular guide in front of the casing that has stiffness that is about 5% to about 80% and more preferably about 5% to about 25% of the stiffness of the casing being run. The lower stiffness of the leading cylindrical or tubular guide section allow it to more easily deflect and travel down the intended wellbore without causing undue stress on the formation. Once the lower stiffness section has entered the curve portion of a wellbore, it would be able to distribute the additional bending force required to deflect the higher stiffness casing behind it and therefore prevent the casing from digging in the wellbore and rock formations.

DETAILED DESCRIPTION

Figure 1:
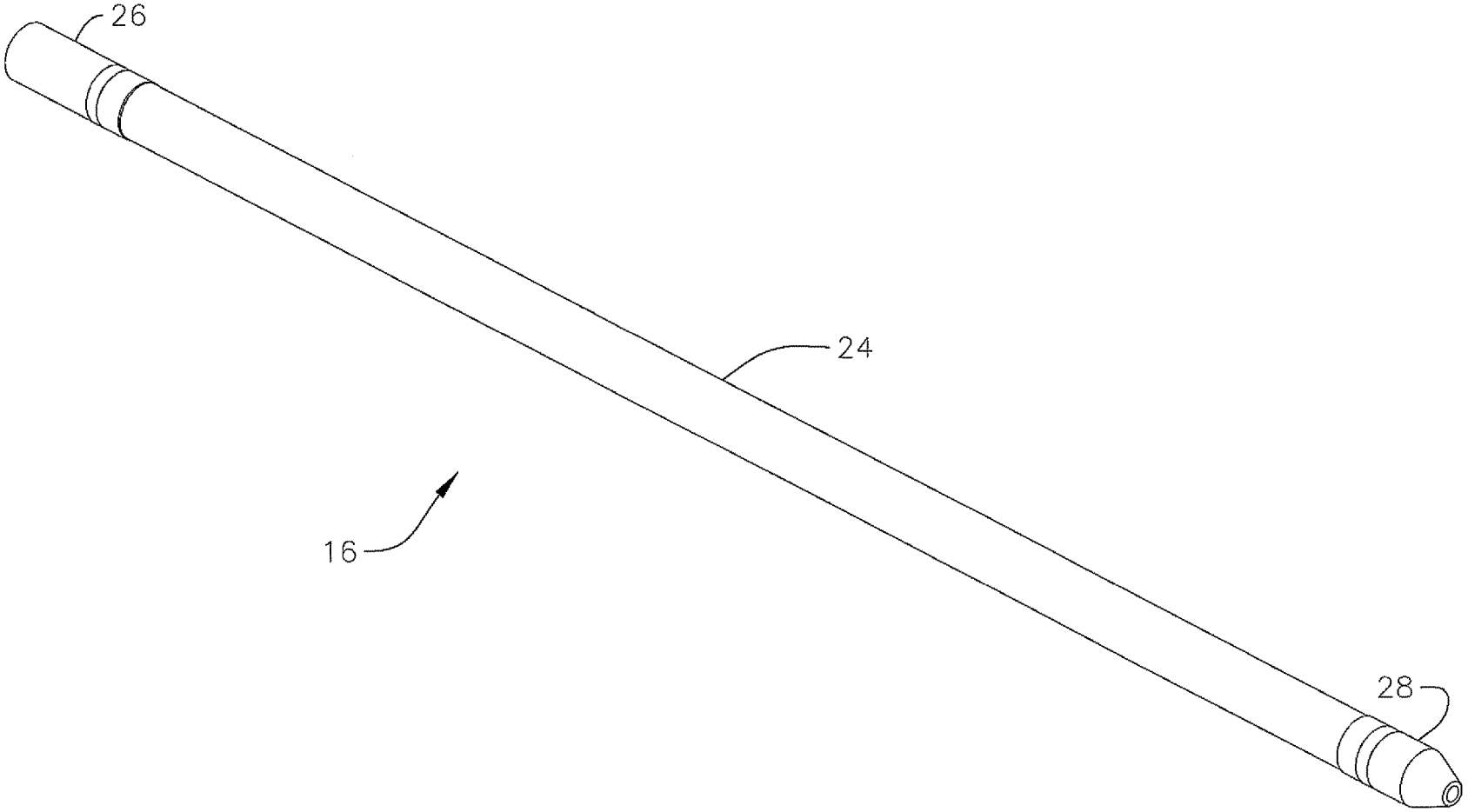
FIG. 1 is a perspective view of the reamer shoe attached to a flexible casing guide running tool.

Running normal wellbore casing requires a large deflection force at the leading edge and to reduce the force required to deflect the casing and allow the leading edge or shoe to follow the casing in the wellbore, a flexible casing guide 16 as shown in FIG. 1 is positioned at the leading edge of the casing. The flexible casing guide 16 requires less force to deflect and therefor follow the curve section of the wellbore. The length and stiffness of the flexible casing guide distributes the normal casing deflection force thereby reducing the risk of sticking the casing through a curved wellbore section. The flexible casing guide 16 can be a short cylindrical guide section, for example from about 20 to about 500 feet long, extending from an end of the normal casing and has a lower stiffness than the casing. The lower stiffness of the casing guide is about 5% to about 80%, and more preferably about 5% to about 25% of the stiffness of the casing. The lower stiffness of the leading cylindrical or tubular guide section of the casing guide 16 allow it to more easily deflect and travel down the intended wellbore without causing undue stress on the formation.

One embodiment would be to produce a section of aluminum tubing as the flexible casing guide 16. Because the modulus "E" of aluminum is approximately 37% of steel, so too would be the stiffness of aluminum tubing with the same geometry as steel casing to be run.

In other embodiments, fiber reinforced composites such as glass, aramid, or carbon fiber with a thermal plastic or thermoset polymer matrix could be utilized to produce a cylindrical guide with a reduced stiffness compared to steel. As an example, glass reinforced epoxy has a typical modulus that is approximately 9% of steel, but the stiffness of these composites can be adjusted by changing the fiber material, fiber orientation and fiber volume fraction to match any desired modulus or elasticity.

Other potential solutions include reducing the OD or wall thickness of the guide which would further reduce area moment of inertia and therefore the stiffness of the guide. In addition, the guide could be created so that the leading edge stiffness is on the lower end of the range (about 5% to about 15% of casing stiffness) with the guide's stiffness increasing as it approaches the junction with the steel casing to provide support to enable the transfer of the deflection force from the casing to the guide so that the stress on the formation required to deflect the casing down the wellbore does not exceed the strength of the formation. The diameter of the guide will depend on the diameter of the casing, however the guide can range in diameter sizes from about 3 inches to about 30 inches.

Because the guide is positioned at the end of the casing string, it may also have the features of the bottom of most casing strings. It should have a radius or chamfer on the leading edge or shoe to provide a ramp to enable the generation of the deflection force, and to spread out the force by increasing the contact area at the leading edge as much as possible. The guide may also have valves or other equipment to enable the casing to fill with fluid as it enters the hole, but also enables cementing after the casing has been run to its final depth. The guide can be connected to the casing by a threaded connection.

Figure 2:
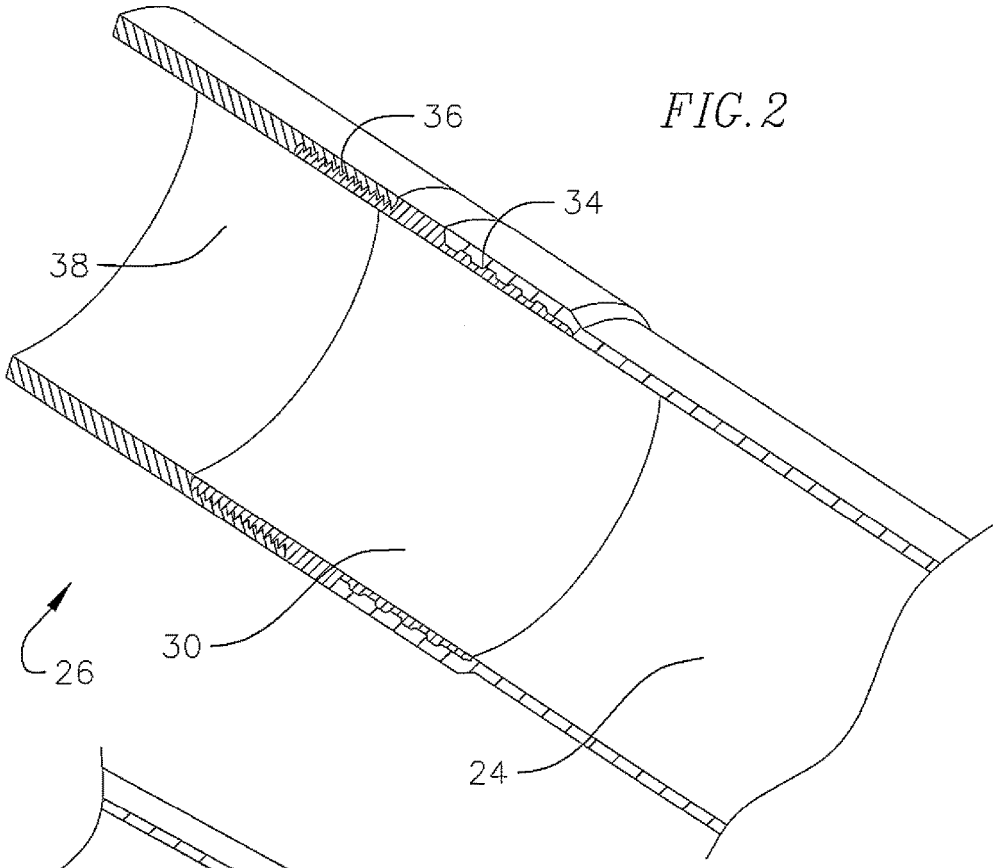
FIG. 2 is a cross-sectional detail of the guide of FIG. 1 illustrating the connection to the casing.
Figure 3:
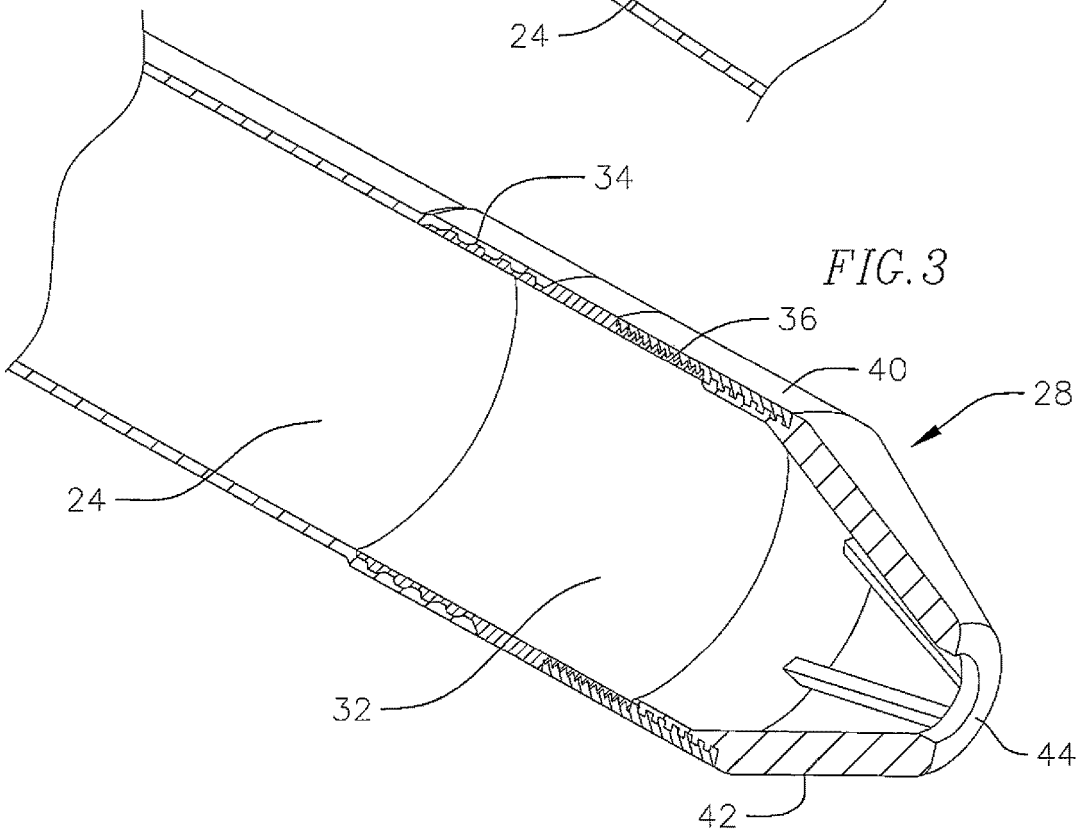
FIG. 3 is a cross-sectional detail view of an opposite end of the guide of FIG. 1.

The flexible casing guide 16 comprises a tube section 24, a casing connection 26, and a nose assembly 28. The nose assembly can be a reamer shoe attachment 62 shown in FIG. 7 and to be discussed in more detail subsequently herein. The casing connection section 26 is positioned on an end of the tube section 24 for connection to the casing and nose assembly 28 is positioned on an opposite end of the tube section 24. The tube section 24 can be a composite material including a long filament glass or vinyl ester epoxy resin. The composite material has a UV protection applied and has a temperature rating of 220° F. For a 7 inch diameter example, the tube section would have a 0.5 inch nominal wall thickness. As shown in FIGS. 2 and 3, the tube section 24 includes aluminum end connectors 30 and 32 positioned on either end of the tube section. One end of the aluminum end connectors includes ribs 34 which are features to lock the composite tube structure to the end connectors. The end connectors 30 and 32 are 6061-T6 aluminum which are anodized for corrosion protection and adhesion to the composite tube. The opposite ends of the aluminum connectors are threaded 36 for connection of a steel crossover 38 and the nose assembly 28. The steel crossover 38 includes threads to mate with threads 36 to attach to the aluminum connector. The opposite end of the steel crossover can include whatever type of connection is necessary for attachment to the casing or other applications.

The nose assembly 28 includes an aluminum connector 40 having threads to connect to threads 36 for aluminum connector 32. The nose assembly can further include a one piece polyurethane nose section 42 having a conical taper to allow easy passage into cutting beds and through liner tops etc. while maintaining some flexibility to distribute point loads. The nose section 42 includes an opening 44 positioned in an end surface of the nose section.

The preferable stiffness of the flexible casing guide 16 is about 5% to about 25% of the stiffness of the casing to be run. For an embodiment which uses a low modulus material, such as glass fiber reinforced composite using a thermoset matrix material, if the low modulus material were bonded or joined directly to the high modulus steel material, the stresses would be very high. Consequently, the transition between the very stiff high modulus steel casing and the low modulus composite material, a material with an intermediate modulus or stiffness is used to reduce the stress levels at the interface. By bonding or joining the composite to aluminum, the interface stresses are greatly reduced. Consequently, the composite tube is formed around an aluminum interface or connector, approximately about 1 to about 4 feet long which is then joined to the steel crossover. As indicated, the aluminum connectors include circumferential protrusions or ribs and the aluminum connectors are placed on a mandrel and the composite material is wound onto the cylindrical mandrel and the aluminum connectors. When the composite material is cured, the ribs serve to lock the composite tube onto the aluminum connector.

Figure 4:
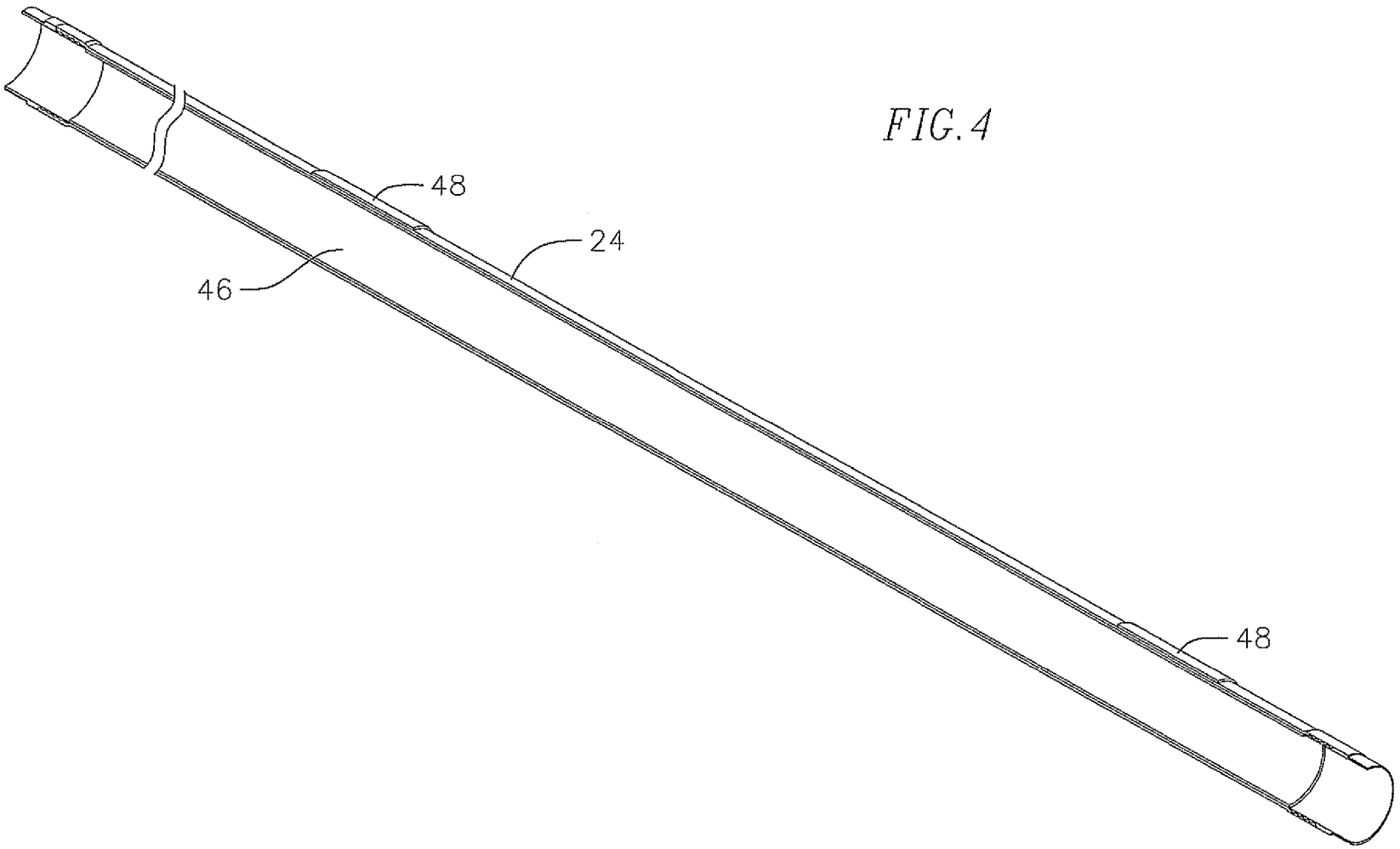
FIG. 4 is a cross-sectional view of the guide of FIG. 1 illustrating an internal liner.
Figure 5:
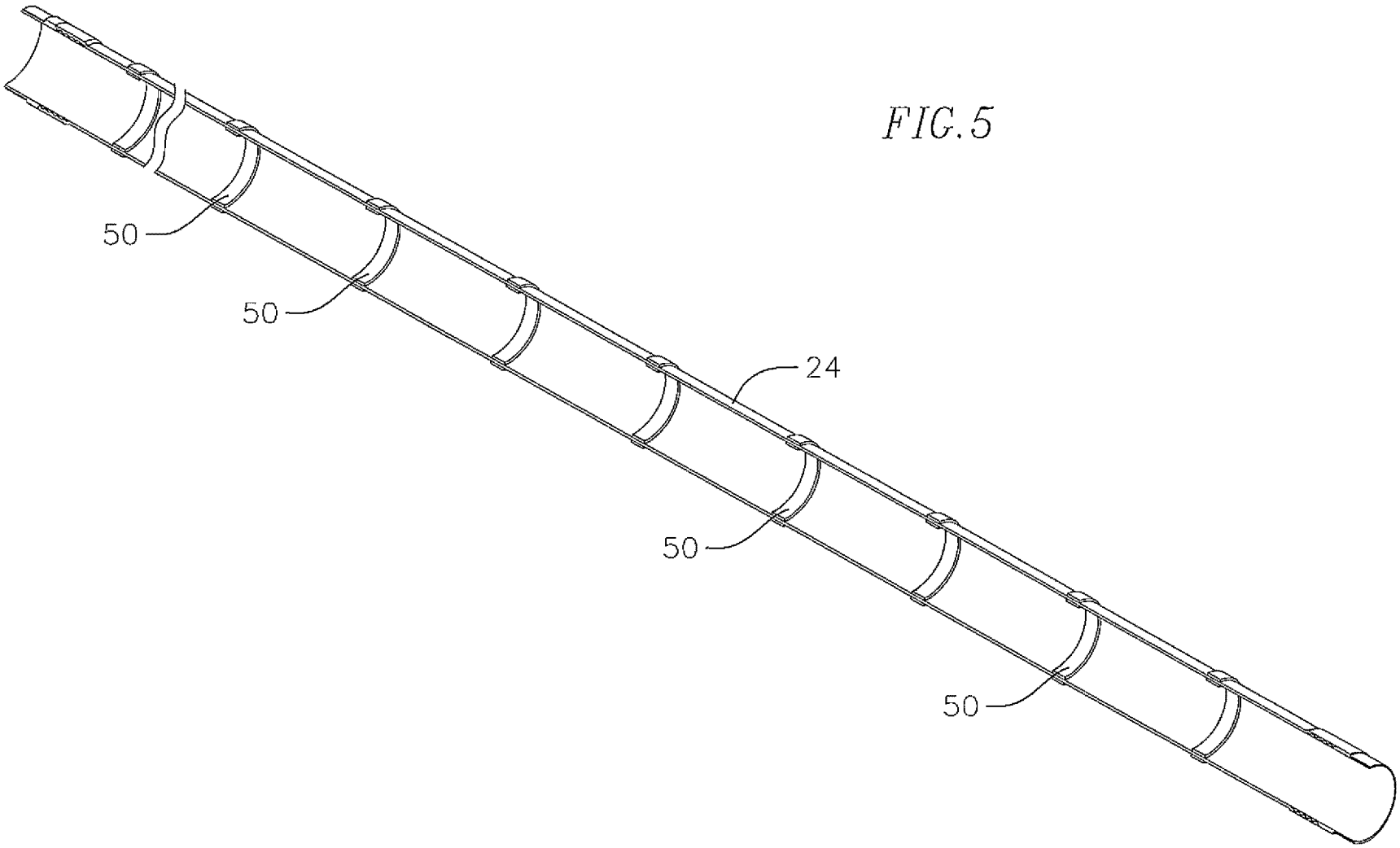
FIG. 5 is a cross-sectional view of the guide of FIG. 1 illustrating compression rings.

As shown in FIG. 4, tube section 24 can include a liner 46 to prevent wear and leakage or gas migration out of the tube section 24. The liner 46 is a thin polymer or metallic lining on the inside diameter of the tube. Alternatively, the liner could be on the outside diameter of the tube. A suitable polymer for the liner could be an ultrahigh molecular weight polyethylene or other thermoset or thermoplastic material. Alternatively, circumferential or longitudinal pads 48 can be positioned on the outside diameter of the tube section 24 to reduce running friction or to prevent wear. The material suitable for pads 48 can be low friction or long wearing polymer or metallic elements, such as ultrahigh molecular weight polyethylene. As shown in FIG. 5, the tube section 24 can include a plurality of compression rings or segments 50 spaced along the internal diameter or the outside diameter of the tube section 24 to increase stiffness, strength and/or wall thickness to increase the collapse pressure rating of the tube section. Collapse strength of thin-walled, large diameter tubes is an instability related phenomenon related to the stiffness of the material, the thickness and the diameter. The compression rings or segments improve collapse strength. This circumferential segments or rings 50 would be made from a higher stiffness material and/or higher strength material than the tube section 24 to provide flexibility with improved collapse strength.

Figure 6:
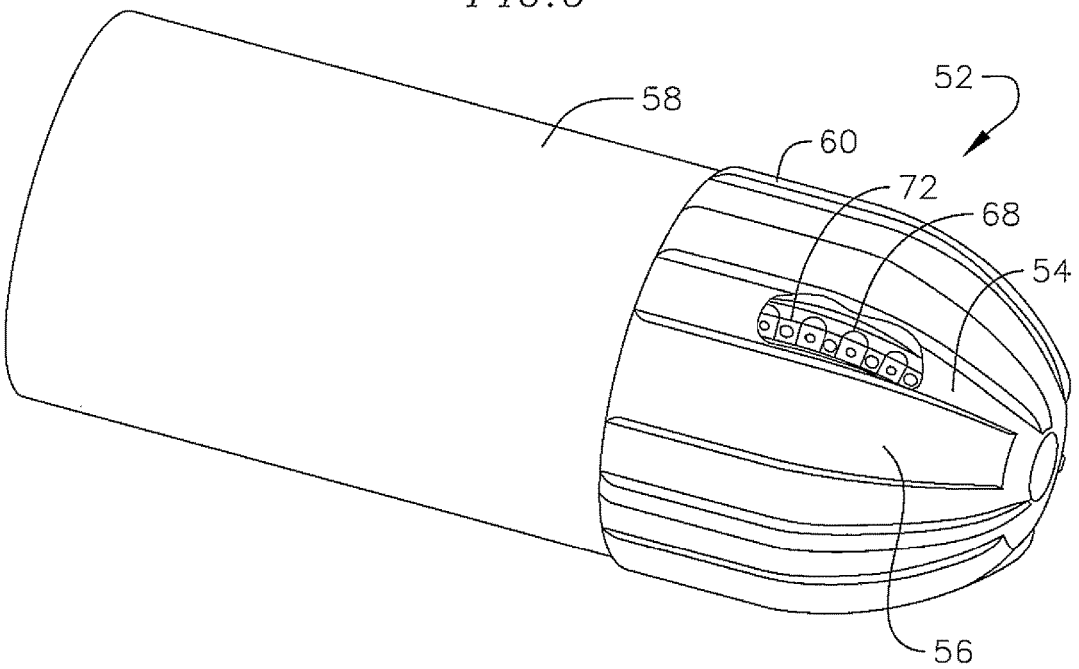
FIG. 6 is a perspective view of an alternative nose design for a flexible casing guide running tool.

Referring to FIG. 6, an alternative configuration for a casing shoe 52 is illustrated. In this embodiment the casing shoe has a flexible nose design with a series of narrow ribs 54 spaced by wider ribs 56. The casing shoe 52 includes an aluminum connector 58 attached to the flexible nose 60. The nose 60 is curved and contains the narrower and wider ribs 54, 56.

Figure 7:
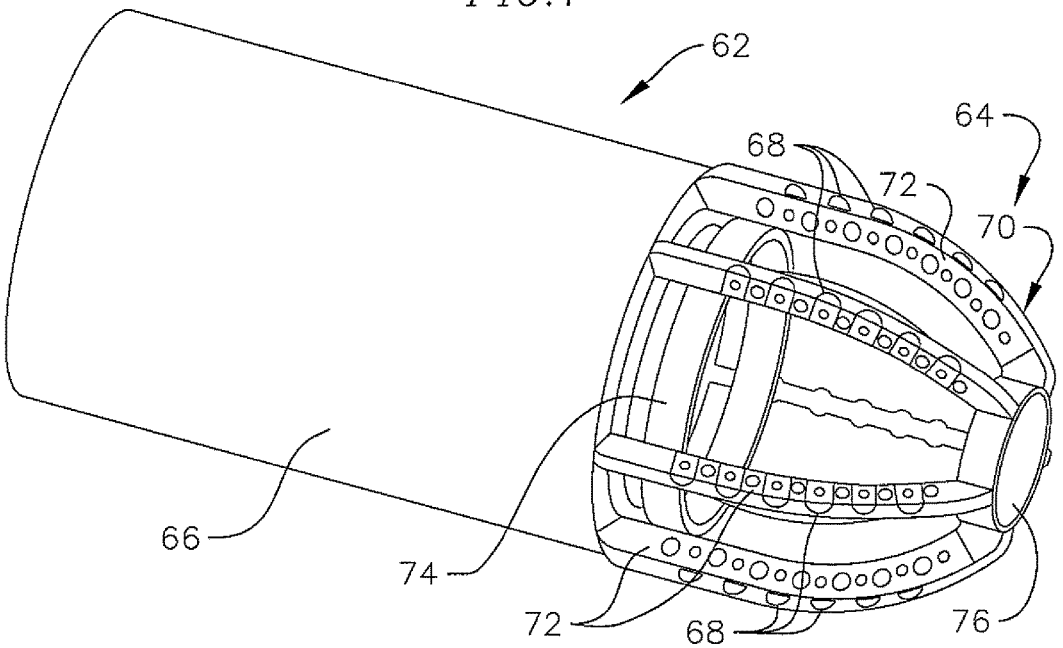
FIG. 7 is a perspective view of the reamer shoe attachment.

FIG. 7 illustrates the reamer shoe attachment 62 of the present invention. The reamer shoe 62 includes a reamer bit 64 attached to an aluminum connector 66. The reamer bit is utilized to open the drilled hole and smooth areas that may have ledges or under gauge areas where the diameter of the hole is not large enough to allow passage of the casing. The reamer shoe including the reamer bit must be able to be drilled at the conclusion of its use. The reamer bit 64 includes a plurality of ceramic inserts 68 made from silicon nitride and/or aluminum oxide. Silicon nitride and aluminum oxide are harder that most rock materials and are easily broken up and flushed harmlessly out of the hole when it is required to drill through the reamer shoe when drilling the next wellbore section. The inserts 68 are held in the reamer bit by a metallic cage 70 comprising a plurality of curved cage members 72 spaced around the circumference of the nose section. Cage 70 also includes reinforcement rings 74 and 76 for attachment of the cage members 72 to one another. The cage 70 locates the inserts at their proper position and provides a load bearing structure to support the loads and conduct heat away from the inserts. The cage would preferably be made using a strong and lightweight aluminum alloy, but could also be made from steel.

The cage 70 and inserts 68 can be cast into the nose section 60 using liquid materials that solidify to form a solid structure including polyurethane and polyurea elastomers; epoxy and vinyl ester thermoset plastics; cast and nylon plastic; and aluminum, brass, bronze or zinc metallic alloys. For the nose structure 60 as shown FIG. 6, the inserts 68 would reside in the narrow ribs 54 on the OD of the reamer shoe, with the wider ribs 56 limiting the depth of the cut of the inserts so that the cutting surfaces are not overloaded. The narrow and wider rib design also ensures that drilling fluid would be guided past the inserts to cool them and transport cuttings uphole.

Although the present invention has been described and illustrated with respect to embodiments thereof, it is to be understood that changes and modifications can be made therein which are within the full intended scope of the invention as hereinafter claimed.

What is claimed is:

1. A drillable reamer shoe comprising:

a reamer body; and a nose section adjacent the reamer body, the nose section having a reamer bit comprising a metallic framework or cage having a plurality of curved cage members spaced around a circumference of the nose section, each cage member containing a plurality of ceramic insert cutting elements, the nose section further having a cast rib portion at each curved cage member and a cast wider rib portion between each rib portion, wherein the wider rib portion is raised above the rib portion forming a channel for the ceramic insert cutting elements.

2. The reamer shoe of claim 1, wherein the ceramic insert cutting elements are silicon nitride and/or aluminum oxide.

3. The drillable reamer shoe of claim 1, wherein the rib portion and wider rib portion are cast into the nose section of the reamer body using liquid materials that solidify to form a solid structure including at least one of polyurethane and polyurea elastomers, epoxy and vinyl ester thermoset plastics, cast nylon plastics, aluminum, brass, bronze or zinc metallic alloys.

4. The drillable reamer shoe of claim 1, in combination with a flexible casing shoe, wherein the drillable reamer shoe is positioned at a front end of the flexible casing shoe.

5. The drillable reamer shoe of claim 4, wherein the flexible casing shoe includes a flexible casing guide.

6. The drillable reamer of claim 5, wherein the flexible casing guide comprises a tubular body having a lower stiffness than a wellbore casing.

7. The drillable reamer of claim 6, wherein the flexible casing guide is fiber reinforced composite tubing.

8. The drillable reamer of claim 6, wherein the flexible casing guide includes aluminum connectors positioned at either end of the guide.

9. The drillable reamer shoe of claim 1, wherein the ceramic insert cutting elements reside in the rib portion of the nose section.

10. The drillable reamer shoe of claim 9, wherein the wider rib portion limits a depth of cut so that cutting surfaces of the ceramic insert cutting elements are not overloaded.

11. The drillable reamer of claim 1, wherein the plurality of curved cage members are connected by reinforcement rings.

12. A drillable reamer shoe assembly having a reamer body section having a nose section adjacent the reamer body section, wherein the reamer body section is connected to a flexible casing guide comprising a tubular body configured to be positioned at an end of a wellbore casing having a lower stiffness than the wellbore casing, and wherein the nose section includes a metallic cage containing a plurality of ceramic cutting inserts positioned in ribs spaced around a circumference of the nose section, the ribs are separated by raised portions thereby forming a channel for the ceramic cutting inserts.

13. The drillable reamer shoe assembly of claim 12, wherein the ceramic cutting inserts are silicon nitride and/or aluminum oxide.

14. The drillable reamer shoe assembly of claim 12, wherein the metallic cage and ceramic cutting inserts are cast into the nose section using liquid materials that solidify to form a solid structure including at least one of polyurethane and polyurea elastomers, epoxy and vinyl ester thermoset plastics, cast nylon plastics, aluminum, brass, bronze or a zinc metallic alloy.

15. The drillable reamer shoe assembly of claim 12, wherein the metallic cage includes a plurality of curved cage members connected by reinforcement rings.

16. The drillable reamer shoe assembly of claim 12, wherein the ribs are narrower than the raised portions.

* * * * *